US005351512A

United States Patent [19]

Pearlman

[11] Patent Number: 5,351,512

[45] Date of Patent: Oct. 4, 1994

[54] DUAL MODE LOCKING SYSTEM FOR TRUCK SERVICE BODIES

[75] Inventor: Daniel Pearlman, Auburn, Pa.

[73] Assignee: Reading Body Works, Reading, Pa.

[21] Appl. No.: 95,088

[22] Filed: Jul. 20, 1993

[51] Int. Cl.[5] ..... E05B 47/02

[52] U.S. Cl. ..... 70/257; 70/279; 292/144; 292/148; 292/162; 292/DIG. 32; 292/DIG. 62

[58] Field of Search ..... 70/257, 279, DIG. 42; 292/157, 144, 148, 162, DIG. 62, DIG. 32

[56] References Cited

U.S. PATENT DOCUMENTS

| | | | |
|---|---|---|---|
| 810,947 | 1/1906 | Jefferis | 292/162 |
| 1,920,868 | 8/1933 | Kirk | 292/144 X |
| 3,831,408 | 8/1974 | Featherman | 70/279 X |
| 4,116,078 | 9/1978 | Kitamura et al. | 70/279 X |
| 4,702,095 | 10/1987 | Ben-Asher | 70/279 |
| 4,866,963 | 9/1989 | Leininger et al. | 292/144 X |

FOREIGN PATENT DOCUMENTS

| | | | |
|---|---|---|---|
| 9571 | of 1907 | United Kingdom | 292/144 |
| 2179696 | 3/1987 | United Kingdom | 70/279 |
| 2202897 | 10/1988 | United Kingdom | 292/DIG. 32 |

*Primary Examiner*—Lloyd A. Gall
*Attorney, Agent, or Firm*—Daniel H. Golub

[57] ABSTRACT

An apparatus for locking and unlocking one or more storage compartments in a truck service body includes a channel assembly that is slidably secured to the service body by at least one channel support. A rod assembly having an L-shaped locking bracket is slidably secured to the service body by a plurality of rod supports. The rod assembly passes through the channel assembly. A handle for manually moving the rod assembly between a locked position and an unlocked position is included. The handle is rigidly secured to the channel assembly and extends outside of the service body. The handle is adapted for coupling to the service body by a manual locking mechanism. An electro-mechanical actuator is coupled to the rod assembly for moving the rod assembly between its locked and unlocked positions. The width of the channel is sufficient to allow the electro-mechanical actuator to move the rod assembly from its locked position to its unlocked position when the handle is coupled to the service body by the manual locking mechanism.

3 Claims, 2 Drawing Sheets

DUAL MODE LOCKING SYSTEM FOR TRUCK SERVICE BODIES

FIELD OF THE INVENTION

The present invention relates to truck service bodies having one or more storage compartments and, in particular, to systems for locking and unlocking the doors to such storage compartments.

BACKGROUND

Truck service bodies typically include one or more storage compartments for storing tools and equipment. A hinge mounted door is typically affixed to each such storage compartment so as to allow a user to gain access to the interior of the compartment, and to protect the contents of the compartment from exterior elements. In the past, manual padlock systems have been employed to secure the contents of such storage compartments against theft. These padlock systems include a rod assembly which is slidably arranged to pass through a bracket affixed to the interior of a compartment door. The bracket includes a hole or an opening that is adapted to receive the rod assembly when the system is in its locked state. The rod assembly extends through the outer surface of the service body where it includes a handle for manually moving the rod assembly between its locked and unlocked states. To prevent theft, the exterior handle may be secured to the outer surface of the truck body by a padlock.

Contractors and others that use service bodies to store tools and equipment often return to their vehicles with tools or other items in their hands. Upon their return to the vehicle, the storage compartments will typically be secured in their locked state. In order to gain access to the interior of these storage compartments, the padlock must be manually unlocked and, once freed from the padlock, the exterior handle must be manually moved to its unlocked position. Since the hands of vehicle users may typically be occupied with tools and the like, it is often inconvenient for such users to manually open their storage compartments upon returning to their vehicles.

It is therefore an object of the present invention to provide a system that allows a vehicle user to lock and unlock storage compartments that have been secured by padlocking, without requiring the user to manually manipulate the padlock arrangement.

It is a further object of the present invention to provide a system that allows a vehicle user to lock and unlock storage compartments that have been secured by padlocking from a remote location that is not directly adjacent to the vehicle.

It is a further object of the present invention to provide a system that gives a vehicle user wireless remote access to storage compartments while, at the same time, allowing the user the option to access such storage compartments by manually manipulating a padlock system.

These and other objects of the invention will be better appreciated after reading the succeeding description of the invention in conjunction with the accompanying drawings.

SUMMARY OF THE INVENTION

An apparatus for locking and unlocking one or more storage compartments in a truck service body includes a channel assembly that is slidably secured to the service body by at least one channel support. A rod assembly having an L-shaped locking bracket is slidably secured to the service body by a plurality of rod supports. The rod assembly passes through the channel assembly. A handle for manually moving the rod assembly between a locked position and an unlocked position is included. The handle is rigidly secured to the channel assembly and extends outside of the service body. The handle is adapted for coupling to the service body by a manual locking means. An electro-mechanical actuator is coupled to the rod assembly for moving the rod assembly between its locked and unlocked positions. The width of the channel is sufficient to allow the electro-mechanical actuator to move the rod assembly from its locked position to its unlocked position when the handle is coupled to the service body by the manual locking means.

DETAILED DESCRIPTION OF THE PREFERRED EMBODIMENT

Figure 1:
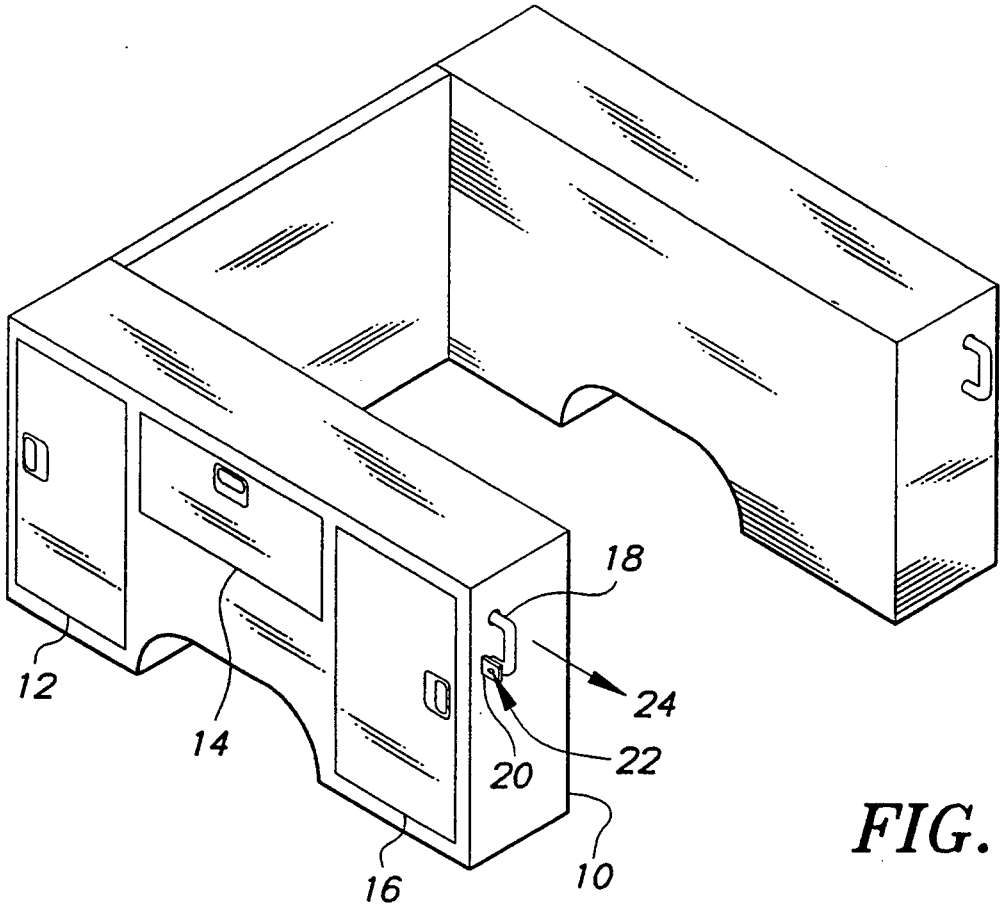
FIG. 1 is a diagram showing a partial perspective view of a truck service body with a plurality of storage compartments.

Referring now to FIG. 1, there is shown a partial perspective view of a truck service body 10 with a plurality of storage compartments 12, 14 and 16 according to the present invention. Manual handle 18 is positioned outside service body 10 and is coupled to rod assembly 30 (shown in FIG. 2) which lies within the interior of service body 10. Handle 18 includes opening 22 for receiving a padlock (not shown). Padlock bracket 20 is rigidly affixed to service body 10 and includes an opening for receiving a padlock. As explained more fully with reference to FIG. 2, handle 18 may be used to place rod assembly 30 in a locked position by aligning opening 22 with the opening in bracket 20. When opening 22 is aligned with the opening in bracket 20, a manual locking means such as a padlock may be placed through both openings to manually secure the contents of compartments 12, 14, 16. When the manual locking means is removed, rod assembly 30 may be manually moved to its unlocked position by pulling handle 18 in the direction of arrow 24.

Figure 2:
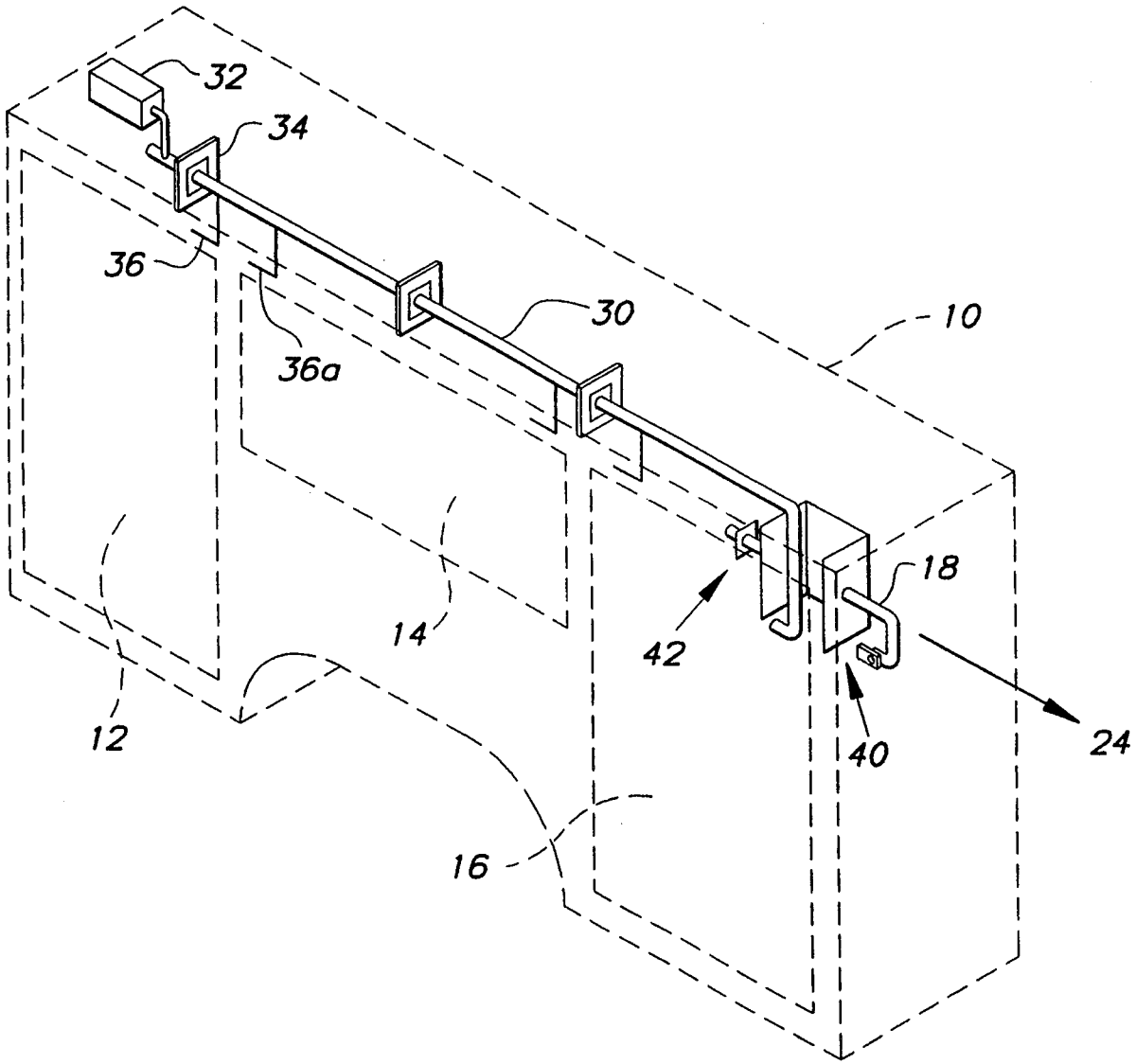
FIG. 2 is a diagram showing a system for locking and unlocking service body storage compartments according to a preferred embodiment of the present invention.
Figure 2:
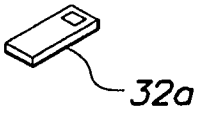

Referring now to FIG. 2, there is shown a system for locking and unlocking service body storage compartments 12, 14 and 16 according to a preferred embodiment of the present invention. Rod assembly 30 is slidably connected to a plurality of rod supports 34 which are affixed along the interiors of compartments 12, 14, 16. Rod assembly 30 includes a plurality of L-shaped locking brackets 36. L-shaped brackets 36 are arranged to slidably pass through corresponding interior brackets (not shown) affixed to the doors of compartments 12, 14, 16. More particularly, each interior bracket includes a hole or an opening that is adapted to receive a corresponding leg 36*a* when rod assembly 30 is in its locked position. Rod assembly 30 may be manually moved from its locked to its unlocked position by pulling handle 18 in the direction of arrow 24 until legs 36*a* are pulled free of the holes in the interior brackets. In a preferred embodiment, spring-loaded ball detents with adjustable tension (not shown) may be affixed to tile interiors of compartments 12, 14 and 16 and brought into engagement with rod assembly 30 to adjust the movement of rod assembly 30.

Electro-mechanical actuator 32 is rigidly affixed to the interior of compartment 12 and to rod assembly 30. In the preferred embodiment, electro-mechanical actuator 32 is activated via a wireless remote controller 32*a* to move rod assembly 30 from its locked to its unlocked position. More particularly, electro-mechanical actuator 32 may be activated to drive rod assembly 30 in the direction of arrow 24 until legs 36*a* are pulled free of the holes in the interior brackets in compartments 12, 14, 16. Similarly, when rod assembly 30 is in its unlocked state, electro-mechanical actuator 32 may be activated to drive rod assembly 30 in the direction opposite of arrow 24 until legs 36*a* are positioned through the holes in the interior brackets in compartments 12, 14, 16, thus driving rod assembly 30 from its unlocked to its locked position. Although it is preferred that controller 32*a* be a wireless remote controller, in alternate embodiments electro-mechanical actuator 32 may be hard wired to controller 32*a*.

Figure 3:
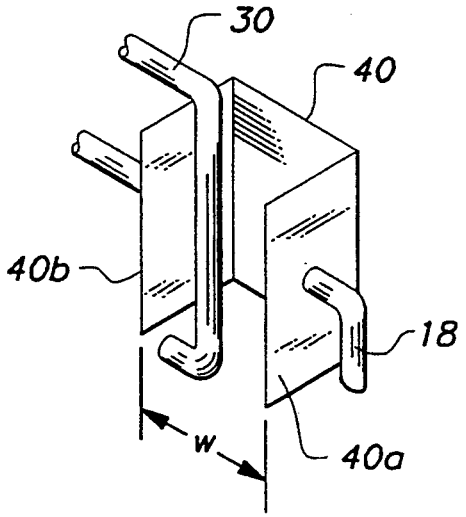
FIG. 3 is a diagram showing a channel assembly that allows a vehicle user to gain access to storage compartments by either remote or manual activation according to a preferred embodiment of the present invention.

Referring now to FIG. 3, there is shown a channel assembly 40 that allows a vehicle user to lock and/or unlock storage compartments 12, 14, 16 by use of either controller 32*a* or handle 18 in accordance with a preferred embodiment of the present invention. Channel assembly 40 is slidably secured to the interior of compartment 16 by channel support bracket 42. Handle 18 is rigidly secured to wall 40*a* of channel assembly 40. Rod assembly 30 is positioned within the interior of channel assembly 40 (between walls 40*a* and 40*b*), but is not affixed to channel assembly 40. When handle 18 is used to manually move rod assembly 30 from is locked to its unlocked position, handle 18 is pulled in the direction of arrow 24 thus bringing wall 40*b* into contact with rod assembly 30. Thereafter, as handle 18 is pulled further in the direction of arrow 24, handle 18 and rod assembly 30 remain coupled (via wall 40*b*), and rod assembly 30 is thereby pulled into its unlocked position.

According to a further aspect of the present invention, when opening 22 is aligned with the opening in bracket 20, and a manual locking means (such as a padlock) has been placed through both openings to manually secure the contents of compartments 12, 14, 16, electro-mechanical actuator 32 may be used to drive rod assembly 30 between its locked and unlocked positions without removal of the manual locking means. More particularly, the width w of channel assembly 40 (defined as the distance between walls 40*a* and 40*b*) is sufficiently large such that electro-mechanical actuator 32 may drive rod assembly 30 between its locked and unlocked positions while the positions of channel assembly 40 and handle 18 remain fixed.

Figure 4:
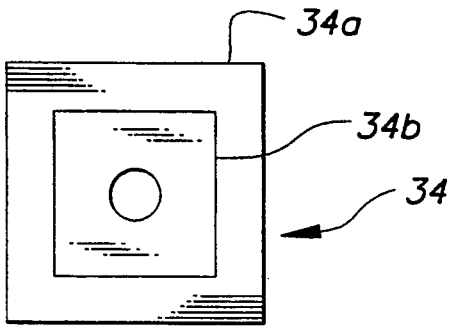
FIG. 4 is a diagram showing a cross-sectional view of a rod support according to a preferred embodiment of the present invention.

Referring now to FIG. 4, there is shown a cross-sectional view of a rod support 34 according to a preferred embodiment of the present invention. Rod support 34 is preferably comprised of a steel casing 34*a* and an insertable sliding means 34*b*. Sliding means 34*b* is preferably formed from teflon and includes a hole or opening for slidably receiving rod assembly 30.

Finally, the apparatus shown by FIG. 2 (including rod assembly 30, actuator 32, rod supports 34, channel assembly 40, channel support 42 and handle 18) may by installed on both sides of a truck service body to secure compartments on either the curb side or road side of a service body. When the apparatus of FIG. 2 is duplicated on both sides of the service body, dual padlocks may be positioned so as to secure both handles 18 to their respective sides of the service body. In accordance with a further aspect of the present invention, when handle 18 on one side of the service body is used to move its corresponding rod assembly 30 to an unlocked position, the rod assembly positioned on the opposing side of the service body will automatically be moved to its unlocked position via the electromechanical actuator on the opposing side of the service body. By this arrangement, a user is afforded access to the compartments on both sides of the service body even though only a single padlock on one side of the service body has been removed and the remaining padlock on the opposing side is still in place.

It will be appreciated that there are considerable variations that can be accomplished in an apparatus of the invention without departing from its scope. As a result, although the preferred embodiment of an apparatus of the invention has been described above, it is emphasized that the invention is not limited to the preferred embodiment, and there exist alternative embodiments that are fully encompassed within the invention's scope, which is intended only to be limited by the scope of the appended claims.

What is claimed is:

1. In a truck service body, an apparatus for locking and unlocking one or more storage compartments comprising:

(A) a channel assembly, said channel assembly being slidably secured to said service body by at least one channel support;

(B) a rod assembly having an L-shaped locking bracket, said rod assembly being slidably secured to said service body by a plurality of rod supports, said rod assembly passing through said channel assembly;

(C) a handle for manually moving said rod assembly between a locked position and an unlocked position, said handle being rigidly secured to said channel assembly and extending outside of said service body, said handle being adapted for coupling to said service body by a manual locking means;

(D) an electro-mechanical actuator, coupled to said rod assembly, for moving said rod assembly between said locked position and said unlocked position;

wherein the width of said channel is sufficient to allow said electro-mechanical actuator to move said rod assembly from said locked position to said unlocked position when said handle is coupled to said service body by said manual locking means.

2. The apparatus of claim 1, further comprising a remote transmitter for controlling said electro-mechanical actuator.

3. The apparatus of claim 1, wherein at least one of said rod supports is comprised of an outer casing and an insertable sliding means positioned within said casing.

* * * * *